US009396692B2

(12) United States Patent
Wang et al.

(10) Patent No.: US 9,396,692 B2
(45) Date of Patent: Jul. 19, 2016

(54) DRIVING CIRCUIT AND OPERATING METHOD THEREOF

(71) Applicant: Raydium Semiconductor Corporation, Hsinchu (TW)

(72) Inventors: Yi-Ting Wang, Pingtung County (TW); Li-Ping Lin, Kaohsiung (TW); Ying-Lieh Chen, Tainan (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 512 days.

(21) Appl. No.: 13/950,652

(22) Filed: Jul. 25, 2013

(65) Prior Publication Data

US 2014/0028641 A1 Jan. 30, 2014

(30) Foreign Application Priority Data

Jul. 27, 2012 (TW) ..... 101127233 A

(51) Int. Cl.
*G09G 3/36* (2006.01)

(52) U.S. Cl.
CPC ..... *G09G 3/3688* (2013.01); *G09G 3/3648* (2013.01); *G09G 2310/027* (2013.01); *G09G 2310/0294* (2013.01); *G09G 2310/0297* (2013.01)

(58) Field of Classification Search
CPC ..... G09G 2310/027; G09G 3/36; G09G 3/3685–3/3696
See application file for complete search history.

(56) References Cited

U.S. PATENT DOCUMENTS

2004/0104880 A1* 6/2004 Kang ..... G09G 3/3688 345/94
2012/0249603 A1* 10/2012 Ban ..... G09G 3/3614 345/690

* cited by examiner

*Primary Examiner* — David Tung

(57) ABSTRACT

The invention provides a driving circuit applied in a LCD apparatus. The driving circuit includes N first channels, N second channels, 2N first switching units, and 2N second switching units. N is a positive integer and N≥2. N second channels correspond to N first channels. When the driving circuit is operated under a first operation mode, N first switching units in the N first channels switch to connect with the corresponding N second channels, and the other N first switching units in the N second channels switch to connect with the corresponding N first channels according to a control signal respectively. N second switching units in the N first channels switch to connect with the corresponding N second channels, and the other N second switching units in the N second channels switch to connect with the corresponding N first channels according to a control signal respectively.

9 Claims, 6 Drawing Sheets

DRIVING CIRCUIT AND OPERATING METHOD THEREOF

CROSS-REFERENCE TO RELATED APPLICATIONS

This non-provisional application claims priorities under 35 U.S.C. §119(a) on Patent Application No. 101127233 filed in Taiwan R.O.C. on Jul. 27, 2012, the entire contents of which are hereby incorporated by reference.

BACKGROUND OF THE INVENTION

1. Field of the Invention

The invention relates to a driving circuit, in particular, to a driving circuit and operating method thereof applied in a LCD apparatus.

2. Description of the Prior Art

In recent years, with the continuous progress of display technology, various types of display apparatuses, such as a LCD display and a plasma display, are shown in the market. Because the volume of the LCD display is much smaller the conventional CRT display, the LCD display using smaller desk space is convenient for the people in modern life.

In general, the driving circuit of the TFT-LCD display includes a timing controller (TCON), a source driver, and a gate driver. Wherein, the timing controller is a control IC used to generate and output a control timing to control the timings of the source driver and the gate driver of the LCD panel. Because DC stress cannot be provided to liquid crystals, the source driver has to output positive voltage and negative voltage at the same time to provide AC voltage to the liquid crystals. However, if every channel has a set of a positive digital-to-analog converter and a negative digital-to-analog converter at the same time, the source driver will occupy too much area of the chip. Therefore, in the conventional source driver, two adjacent channels share a set of the positive digital-to-analog converter and the negative digital-to-analog converter, and the positive voltage and the negative voltage can be outputted at the same time by switching only one set of multiplexers.

Please refer to FIG. 1 and FIG. 2. FIG. 1 and FIG. 2 illustrate functional block diagrams of the source driver operated under a first operation mode and a second operating mode of the conventional LCD apparatus. As shown in FIG. 1 and FIG. 2, the source driver 1 includes a first data latch 11, a second data latch 12, a first multiplexer 13, a P-type digital-to-analog converter 14, a N-type digital-to-analog converter 15, a second multiplexer 16, a first amplifier 17, a second amplifier 18, a first output pad 19, and a second output pad 20.

It can be found from FIG. 1 that when the source driver 1 is operated under the first operation mode, the source driver 1 will save a first digital data signal DS1 and a second digital data signal DS2 in the first data latch 11 and the second data latch 12 respectively. Then, the source driver 1 will determine that the first multiplexer 13 will not perform polarity conversion of digital signal according to the received polarity control signal, so that the first digital data signal DS1 and the second digital data signal DS2 will be outputted to the P-type digital-to-analog converter 14 and the N-type digital-to-analog converter 15 respectively. Then, the P-type digital-to-analog converter 14 and the N-type digital-to-analog converter 15 will perform digital-to-analog conversion on the first digital data signal DS1 and the second digital data signal DS2 respectively to convert them into a first analog data signal AS1 and a second analog data signal AS2 and output the first analog data signal AS1 and the second analog data signal AS2 to the second multiplexer 16. The second multiplexer 16 will not perform polarity conversion according to the polarity control signal, and transmit the first analog data signal AS1 and the second analog data signal AS2 to the first amplifier 17 and the second amplifier 18 respectively. After the first amplifier 17 and the second amplifier 18 amplifies the first analog data signal AS1 and the second analog data signal AS2 respectively, they will be outputted to the LCD panel (not shown in the figure) through the first output pad 19 and the second output pad 20. Wherein, the first analog data signal AS1 outputted by the first output pad 19 has a positive polarity voltage, and the second analog data signal AS2 outputted by the second output pad 20 has a negative polarity voltage.

It can be found from FIG. 2 that when the source driver 1 is operated under the second operation mode, the source driver 1 will save the first digital data signal DS1 and the second digital data signal DS2 in the first data latch 11 and the second data latch 12 respectively. Then, the source driver 1 will determine that the first multiplexer 13 should perform polarity conversion of digital signal according to the received polarity control signal, so that the first digital data signal DS1 and the second digital data signal DS2 will be outputted to the N-type digital-to-analog converter 15 and the P-type digital-to-analog converter 14 respectively. Then, the P-type digital-to-analog converter 14 and the N-type digital-to-analog converter 15 will perform digital-to-analog conversion on the second digital data signal DS2 and the first digital data signal DS1 respectively to convert them into the second analog data signal AS2 and the first analog data signal AS1 and output the second analog data signal AS2 and the first analog data signal AS1 to the second multiplexer 16. The second multiplexer 16 will perform polarity conversion according to the polarity control signal, and transmit the second analog data signal AS2 and the first analog data signal AS1 to the second amplifier 18 and the first amplifier 17 respectively. After the first amplifier 17 and the second amplifier 18 amplifies the first analog data signal AS1 and the second analog data signal AS2 respectively, they will be outputted to the LCD panel (not shown in the figure) through the first output pad 19 and the second output pad 20. Wherein, the first analog data signal AS1 outputted by the first output pad 19 has a negative polarity voltage, and the second analog data signal AS2 outputted by the second output pad 20 has a positive polarity voltage.

The above-mentioned driving circuit structure can meet the requirement of 1 dot inversion channel arrangement way, for example, the positive and negative channels interlacing arrangement of (+, −, +, −, +, −, +, −), and meet the requirement of (2V+1) dot inversion channel arrangement way, for example, the positive and negative channels arrangement of (+, −, −, +, +, −, −, +).

Therefore, the invention provides a driving circuit applied in a LCD apparatus and operating method thereof different from the above-mentioned driving circuit structure to meet the requirements of 1 dot inversion and (2V+1) dot inversion at the same time to solve the above-mentioned problems.

SUMMARY OF THE INVENTION

A first embodiment of the invention is a driving circuit applied in a LCD apparatus. In this embodiment, the driving circuit at least includes N first channels, N second channels, 2N first switching units, and 2N second switching units. N is a positive integer and N≥2. The N second channels correspond to the N first channels respectively. The 2N first switching units are disposed in the N first channels and the N second channels respectively. The 2N second switching units are disposed in the N first channels and the N second channels respectively.

When the driving circuit is operated under a first operation mode, the N first switching units in the N first channels will be switched to connect with corresponding N second channels respectively according to a control signal, and the other N first switching units in the N second channels will be switched to connect with corresponding N first channels respectively according to the control signal. The N second switching units in the N first channels will be switched to connect with corresponding N second channels respectively according to the control signal, and the other N second switching units in the N second channels will be switched to connect with corresponding N first channels respectively according to the control signal.

In practical applications, when the driving circuit is operated under a second operation mode, a first switching unit in any first channel is switched to connect with adjacent another first channel according to the control signal, and the other first switching unit in the any first channel is also switched to connect with the first channel; a first switching unit in any second channel is switched to connect with adjacent another second channel according to the control signal, and the other first switching unit in the any second channel is also switched to connect with the second channel according to the control signal. A second switching unit in a first channel is switched to connect with another first channel according to the control signal, and the other second switching unit in the another first channel is also switched to connect with the first channel; a second switching unit in a second channel is switched to connect with another second channel according to the control signal, and the other second switching unit in the another second channel is also switched to connect with the second channel according to the control signal.

When N=4, the four first channels include a first first channel, a second first channel, a third first channel, and a fourth first channel; the four second channels include a first second channel, a second second channel, a third second channel, and a fourth second channel. The first first channel is disposed adjacent to the second first channel and the first second channel; the second first channel is disposed adjacent to the first first channel and the second second channel; the first second channel is disposed adjacent to the first first channel and the second second channel; the third first channel is disposed adjacent to the fourth first channel and the third second channel; the fourth first channel is disposed adjacent to the third first channel and the fourth second channel; the third second channel is disposed adjacent to the third first channel and the fourth second channel.

A second embodiment of the invention is a driving circuit operating method. In this embodiment, the driving circuit at least includes N first channels, N second channels, 2N first switching units, and 2N second switching units. N is a positive integer and N≥2. The N second channels correspond to the N first channels respectively. The 2N first switching units are disposed in the N first channels and the N second channels respectively. The 2N second switching units are disposed in the N first channels and the N second channels respectively.

When the driving circuit is operated under a first operation mode, the method includes steps of: switching the N first switching units in the N first channels to connect with corresponding N second channels respectively according to a control signal, and switching the other N first switching units in the N second channels to connect with corresponding N first channels respectively according to the control signal; switching the N second switching units in the N first channels to connect with corresponding N second channels respectively according to the control signal, and switching the other N second switching units in the N second channels to connect with corresponding N first channels respectively according to the control signal.

Compared to the prior arts, the driving circuit of the invention different from the prior arts can not only meet the requirements of 1 dot inversion and (2V+1) dot inversion at the same time, but also when N=4, the specific arrangement of the four first channels and four second channels in the invention will not increase additional chip area occupied by the driving circuit. Therefore, the driving circuit of the invention and the LCD apparatus using the driving circuit will have good market competitiveness.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A first embodiment of the invention is a driving circuit. In this embodiment, the driving circuit can be a source driving circuit applied in a TFT-LCD display, but not limited to this case. The driving circuit at least includes N first channels, N second channels, 2N first switching units, and 2N second switching units. N is a positive integer and N≥2. The N second channels correspond to the N first channels respectively. The 2N first switching units are disposed in the N first channels and the N second channels respectively. The 2N second switching units are disposed in the N first channels and the N second channels respectively. The N first digital-to-analog converting units and the N second digital-to-analog converting units are interlaced in the N first channels and the N second channels in order respectively. It should be noticed that the driving circuit has two operation modes introduced as follows.

Figure 1:
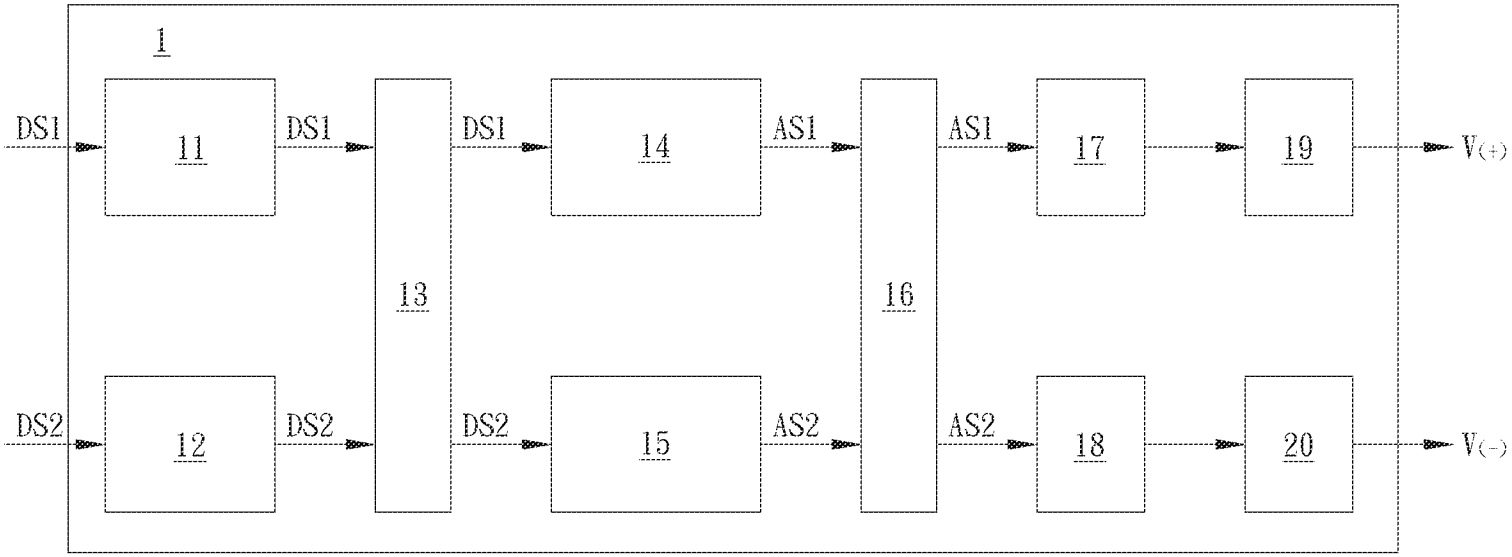
FIG. 1 (PRIOR ART)
FIG. 1 and FIG. 2 illustrate functional block diagrams of the source driver operated under a first operation mode and a second operating mode of the conventional LCD apparatus.
Figure 2:
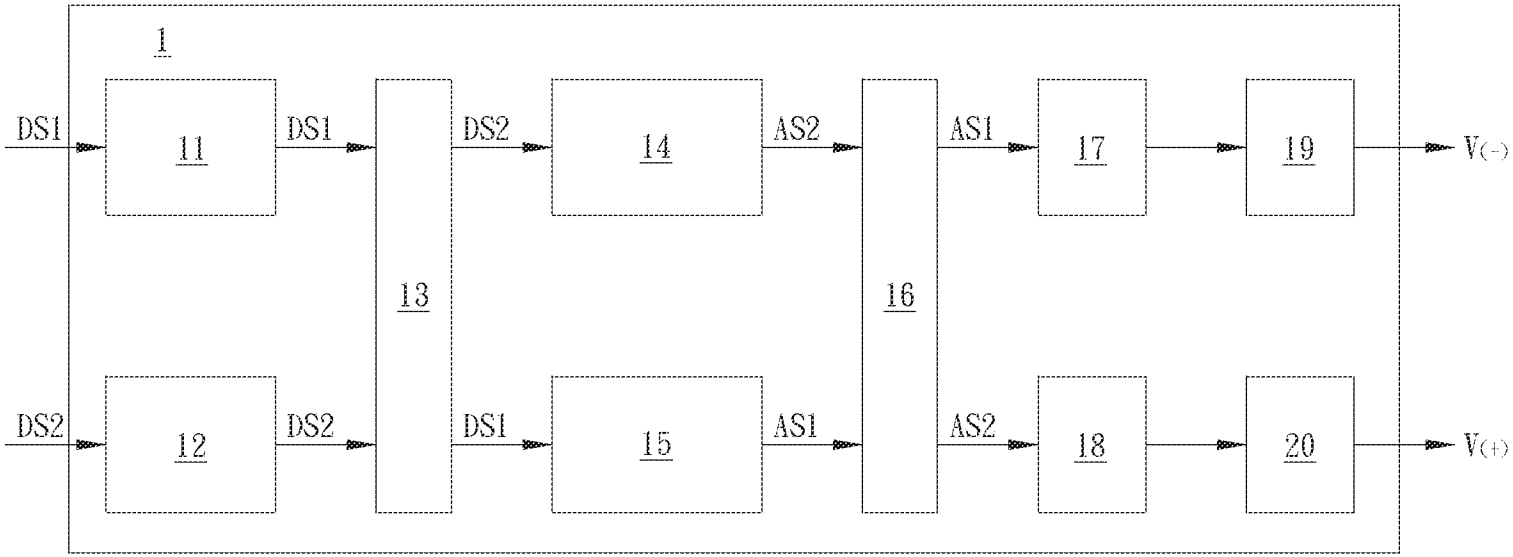
FIG. 2 (PRIOR ART)
Figure 3:
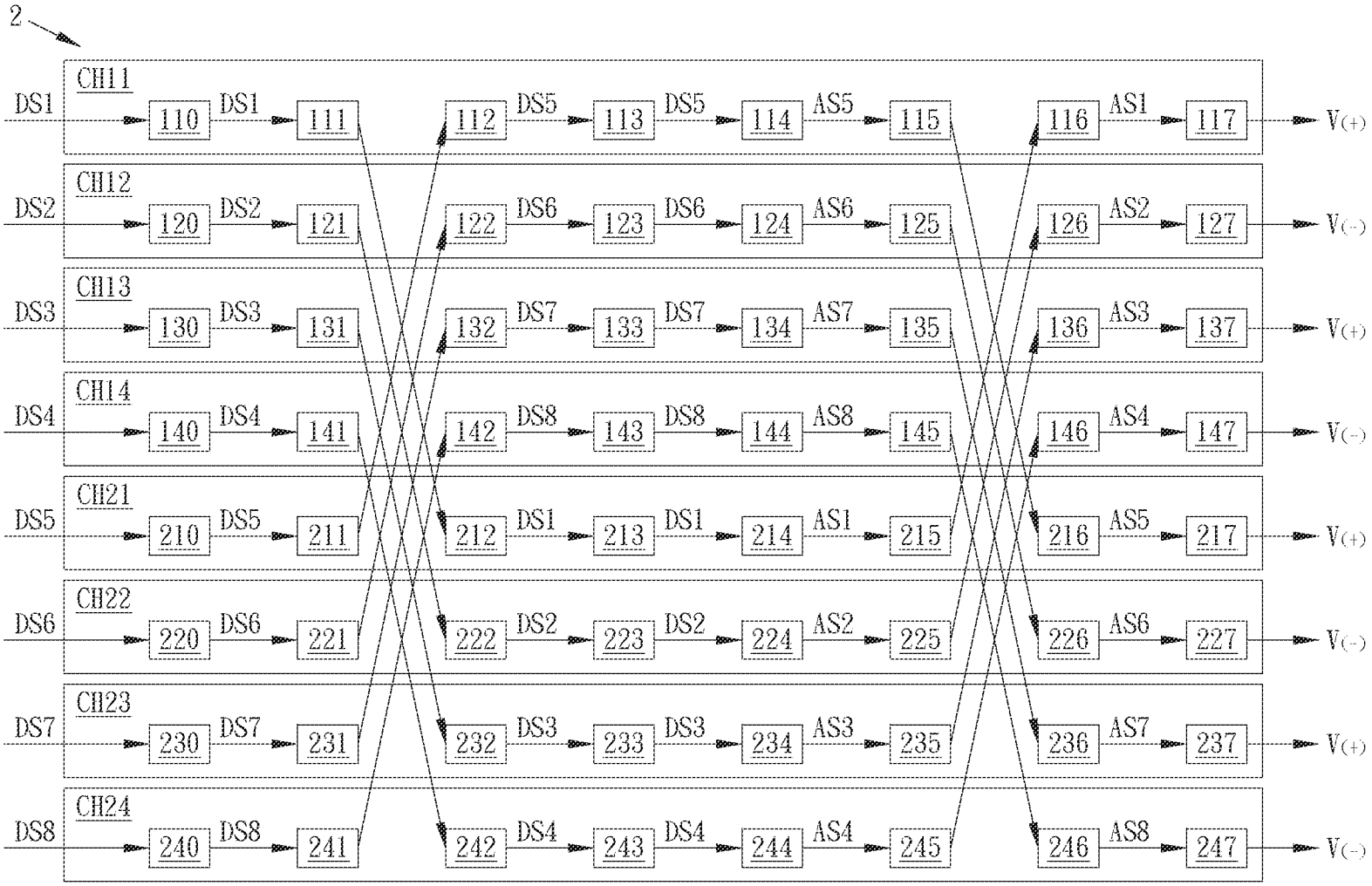
FIG. 3 illustrates a functional block diagram of the driving circuit operated under a first operation mode in an embodiment of the invention.

At first, please refer to FIG. 3. FIG. 3 illustrates a functional block diagram of the driving circuit operated under a first operation mode of this embodiment. As shown in FIG. 3, in this embodiment, N=4, that is to say, the driving circuit 2 includes four first channels CH11~CH14 and four second channels CH21~CH24. Wherein, data latch units 110 and 112, a first switching unit 111, a level shift unit 113, a first digital-to-analog converter 114, a second switching unit 115, an amplifier unit 116, and an output pad 117 are disposed in the first channel CH11; data latch units 120 and 122, a first switching unit 121, a level shift unit 123, a second digital-to-analog converter 124, a second switching unit 125, an amplifier unit 126, and an output pad 127 are disposed in the first channel CH12; data latch units 130 and 132, a first switching unit 131, a level shift unit 133, a first digital-to-analog converter 134, a second switching unit 135, an amplifier unit 136, and an output pad 137 are disposed in the first channel CH13; data latch units 140 and 142, a first switching unit 141, a level shift unit 143, a second digital-to-analog converter 144, a second switching unit 145, an amplifier unit 146, and an output pad 147 are disposed in the first channel CH14.

Data latch units 210 and 212, a first switching unit 211, a level shift unit 213, a first digital-to-analog converter 214, a second switching unit 215, an amplifier unit 216, and an output pad 217 are disposed in the second channel CH21; data latch units 220 and 222, a first switching unit 221, a level shift unit 223, a second digital-to-analog converter 224, a second switching unit 225, an amplifier unit 226, and an output pad 227 are disposed in the second channel CH22; data latch units 230 and 232, a first switching unit 231, a level shift unit 233, a first digital-to-analog converter 234, a second switching unit 235, an amplifier unit 236, and an output pad 237 are disposed in the second channel CH23; data latch units 240 and 242, a first switching unit 241, a level shift unit 243, a second digital-to-analog converter 244, a second switching unit 245, an amplifier unit 246, and an output pad 247 are disposed in the second channel CH24.

In practical application, the first switching units and the second switching units can be multiplexers; the first digital-to-analog converting units can be positive digital-to-analog converters, and the second digital-to-analog converting units can be negative digital-to-analog converters, but not limited to this case.

When the driving circuit 2 is operated under the first operation mode, the first digital data signal DS1 transmitted by the first channel CH11 will be inputted into the first switching unit 111 through the data latch unit 110. At this time, the first switching unit 111 will switch the data latch unit 212 connected to the second channel CH21 and transmit the first digital data signal DS1 to the data latch unit 212 of the second channel CH21. Then, after the first digital data signal DS1 is processed by the level shift unit 213, the first digital-to-analog converter 214 will convert the level-shifted first digital data signal DS1 into the first analog data signal AS1 and output the first analog data signal AS1 to the second switching unit 215. Afterwards, the second switching unit 215 will switch back to connect with the amplifier unit 116 of the first channel CH11 and transmit the first analog data signal AS1 to the amplifier unit 116 of the first channel CH11. After the first analog data signal AS1 is amplified by the amplifier unit 116, the output pad 117 will output the positive voltage to the LCD panel (not shown in figures).

Correspondingly, the five digital data signal DS5 transmitted by the second channel CH21 will be inputted into the first switching unit 211 through the data latch unit 210. At this time, the first switching unit 211 will switch the data latch unit 112 connected to the first channel CH11 and transmit the five digital data signal DS5 to the data latch unit 112 connected to the first channel CH11. Then, after the five digital data signal DS5 is processed by the level shift unit 113, the first digital-to-analog converter 114 will convert the level-shifted five digital data signal DS5 into the five analog data signal AS5 and output the five analog data signal AS5 to the second switching unit 115. Afterwards, the second switching unit 115 will switch back to connect with the amplifier unit 216 of the second channel CH21 and transmit the five analog data signal AS5 to the amplifier unit 216 of the second channel CH21. After the five analog data signal AS5 is amplified by the amplifier unit 216, the output pad 217 will output the positive voltage to the LCD panel (not shown in figures).

It can be found that under the first operation mode, the first switching unit and the second switching unit of the first channel CH11 and the second channel CH21 of the driving circuit 2 will switch to each other. In addition, the switching conditions between the first channel CH12 and the second channel CH22, the first channel CH13 and the second channel CH23, the first channel CH14 and the second channel CH24 of the driving circuit 2 will be similar to the above-mentioned switching condition between the first channel CH11 and the second channel CH21. It will be not described again here.

Figure 4:
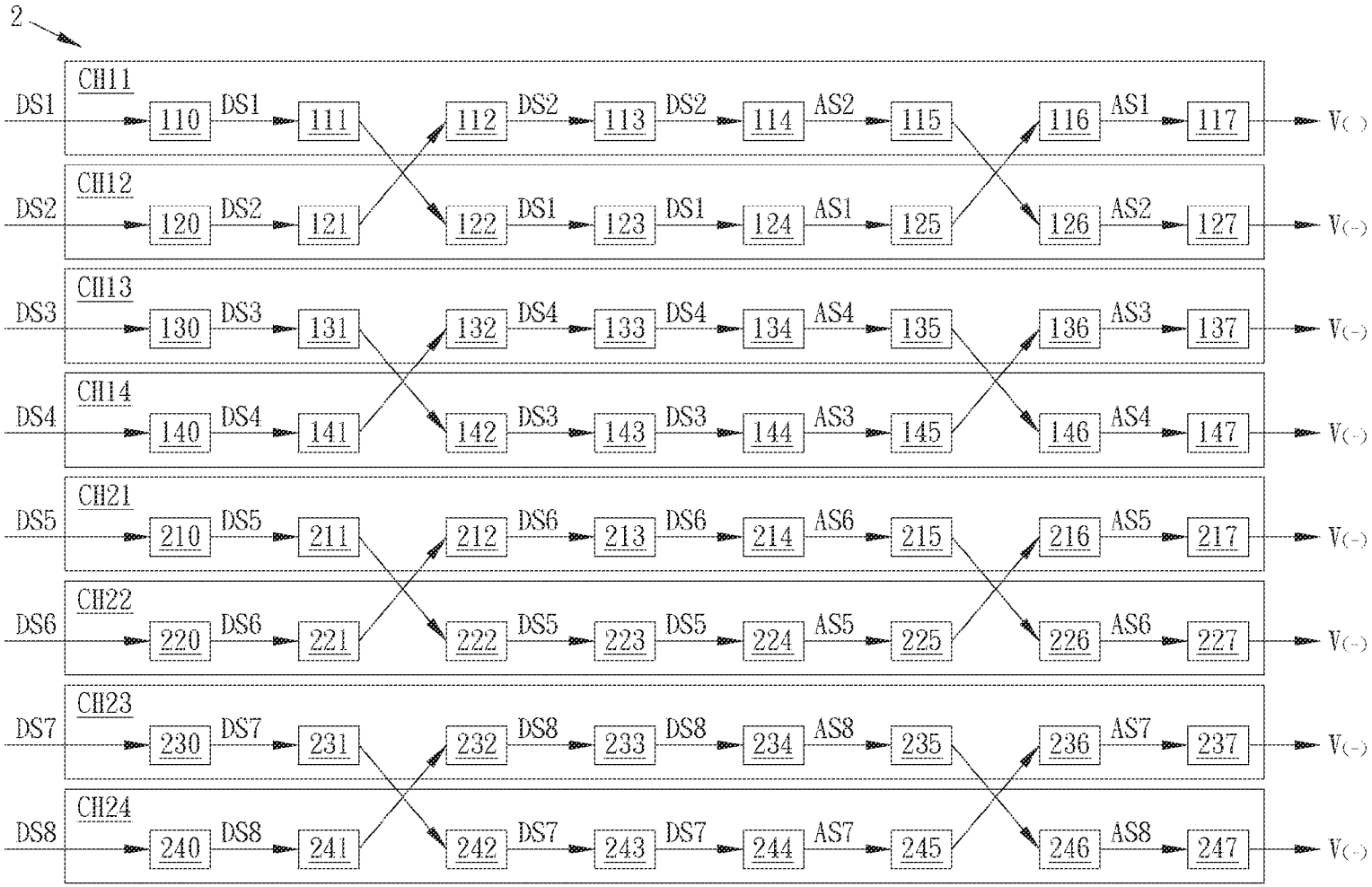
FIG. 4 illustrates a functional block diagram of the driving circuit of FIG. 3 operated under a second operation mode.

Then, please refer to FIG. 4. FIG. 4 illustrates a functional block diagram of the driving circuit operated under a second operation mode of this embodiment. As shown in FIG. 4, when the driving circuit 2 is operated under the second operation mode, the adjacent first channel CH11 and second channel CH12 will switch to each other; the adjacent first channel CH13 and second channel CH14 will switch to each other; the adjacent first channel CH21 and second channel CH22 will switch to each other; the adjacent first channel CH23 and second channel CH24 will switch to each other. Compared to FIG. 3, the switching conditions under the second operation mode shown in FIG. 4 is obviously different from the switching conditions under the first operation mode shown in FIG. 3.

Taking the first channels CH11 and CH12 for example, when the driving circuit 2 is operated under the second operation mode, the first digital data signal DS1 transmitted by the first channel CH11 will be inputted into the first switching unit 111 through the data latch unit 110. At this time, the first switching unit 111 will switch the data latch unit 122 connected to the first channel CH12 and transmit the first digital data signal DS1 to the data latch unit 122 of the first channel CH12. Then, after the first digital data signal DS1 is processed by the level shift unit 123, the first digital-to-analog converter 124 will convert the level-shifted first digital data signal DS1 into the first analog data signal AS1 and output the first analog data signal AS1 to the second switching unit 125. Afterwards, the second switching unit 125 will switch back to connect with the amplifier unit 116 of the first channel CH11 and transmit the first analog data signal AS1 to the amplifier unit 116 of the first channel CH11. After the first analog data signal AS1 is amplified by the amplifier unit 116, the output pad 117 will output the negative voltage to the LCD panel (not shown in figures).

Correspondingly, the second digital data signal DS2 transmitted by the first channel CH12 will be inputted into the first switching unit 121 through the data latch unit 120. At this time, the first switching unit 121 will switch the data latch unit 112 connected to the first channel CH11 and transmit the second digital data signal DS2 to the data latch unit 112 connected to the first channel CH11. Then, after the second digital data signal DS2 is processed by the level shift unit 113, the first digital-to-analog converter 114 will convert the level-shifted second digital data signal DS2 into the second analog data signal AS2 and output the second digital data signal DS2 to the second switching unit 115. Afterwards, the second switching unit 115 will switch back to connect with the amplifier unit 126 of the first channel CH12 and transmit the second analog data signal AS2 to the amplifier unit 126 of the first channel CH12. After the second analog data signal AS2 is amplified by the amplifier unit 126, the output pad 127 will output the positive voltage to the LCD panel (not shown in figures).

From FIG. 3 and FIG. 4, it can be found that when the driving circuit 2 is operated under the first operation mode, the structure of the driving circuit 2 can meet the requirement of (2V+1) dot inversion channel arrangement way (+, −, −, +, +, −, −, +); when the driving circuit 2 is operated under the second operation mode, the structure of the driving circuit 2 can also meet the requirement of 1 dot inversion channel arrangement way (+, −, +, −, +, −, +, −). Therefore, the different channel arrangement ways of polarity inversion can be met at the same time.

Figure 5:
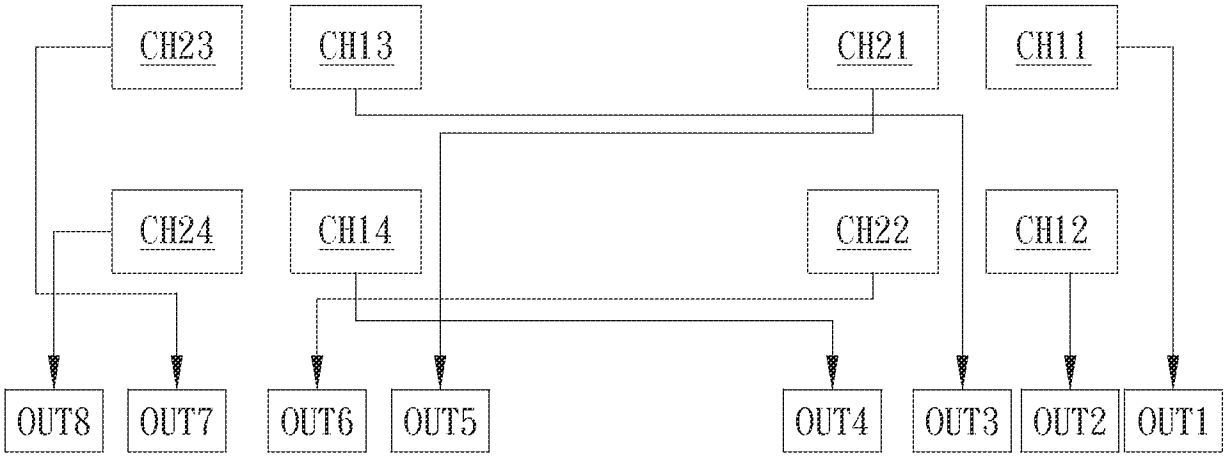
FIG. 5 illustrates a preferred embodiment of arrangement of the channels in the driving circuit.

Then, please refer to FIG. 5. FIG. 5 illustrates a preferred embodiment of arrangement between the channels CH11~CH14 and CH21~CH24 in the driving circuit 2. Since when the driving circuit 2 is operated under the first operation mode, the first channel CH11 and the second channel CH21 will switch to each other; when the driving circuit 2 is operated under the second operation mode, the first channel CH11 and the second channel CH12 will switch to each other. Therefore, as shown in FIG. 5, the second channel CH21 and the first channel CH12 will be arranged near the first channel CH11. Similarly, since when the driving circuit 2 is operated under the first operation mode, the first channel CH12 and the second channel CH22 will switch to each other; when the driving circuit 2 is operated under the second operation mode, the first channel CH12 and the first channel CH11 will switch to each other. Therefore, as shown in FIG. 5, the second channel CH22 and the first channel CH11 will be arranged near the first channel CH12. The other switching conditions will be similar to the above-mentioned switching conditions, and they will not be described again here.

It should be noticed that when the arrangement of FIG. 5 is used to the channels CH11~CH14 and CH21~CH24 of the driving circuit 2, it will be the best arrangement way. Therefore, compared to the driving circuits of the prior arts, the chip area occupied by the driving circuit 2 should be not additionally added.

In practical applications, the numbers of the first channels and the second channels are not limited to 4, they can be adjusted based on practical needs.

Figure 6:
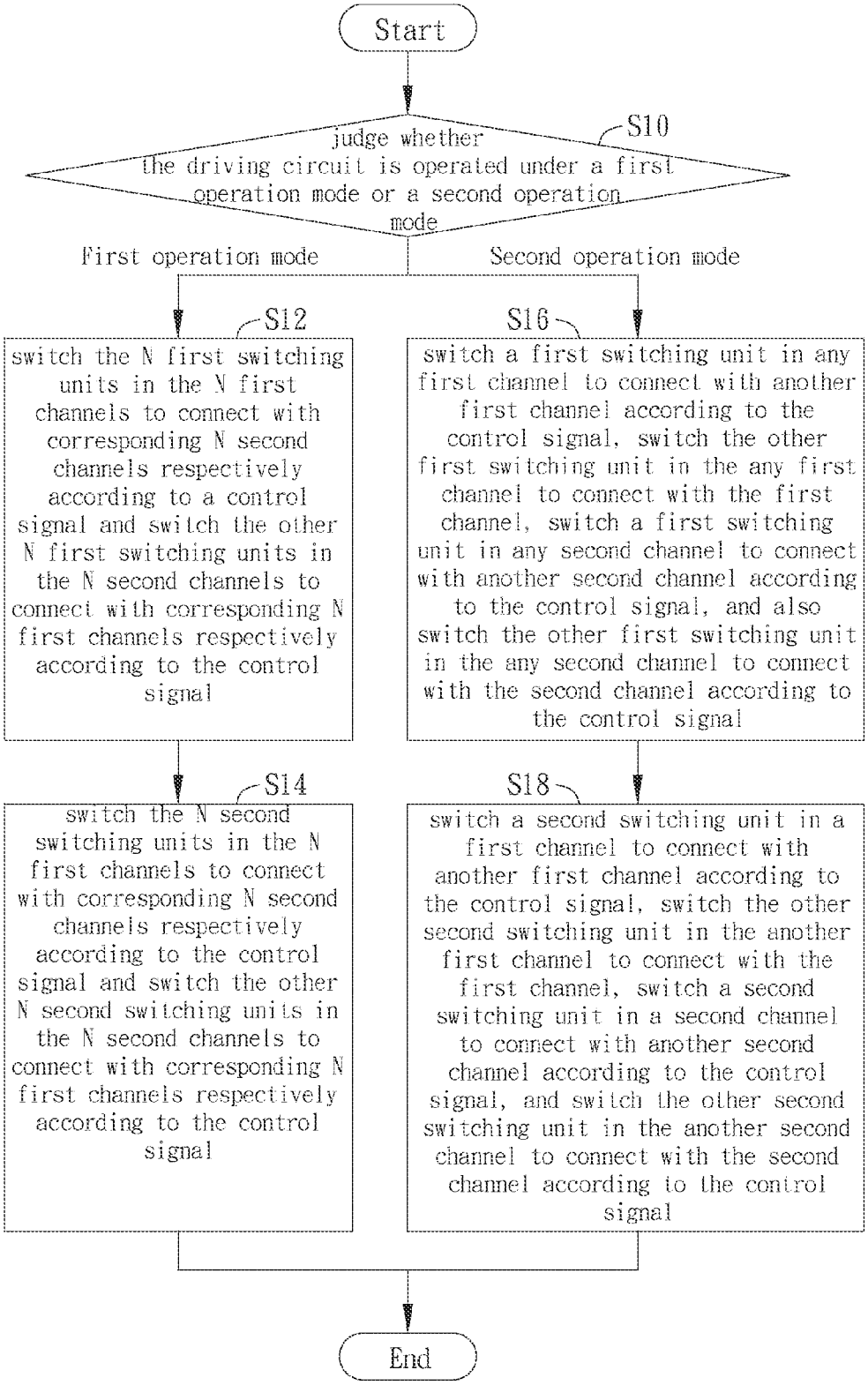
FIG. 6 illustrates a flowchart of the driving circuit operating method in the second embodiment of the invention.

Another embodiment of the invention is a driving circuit operating method. In this embodiment, the driving circuit operating method is applied in a driving circuit of a LCD apparatus, but not limited to this. The driving circuit has two operation modes. The driving circuit includes N first channels, N second channels, 2N first switching units, and 2N second switching units. N is a positive integer and N≥2. The N second channels correspond to the N first channels respectively. The 2N first switching units are disposed in the N first channels and the N second channels respectively. The 2N second switching units are disposed in the N first channels and the N second channels respectively. Please refer to FIG. 6. FIG. 6 illustrates a flowchart of the driving circuit operating method of this embodiment.

As shown in FIG. 6, in the step S10, the method judges whether the driving circuit is operated under a first operation mode or a second operation mode. If the judgment of the step S10 is that the driving circuit is operated under the first operation mode, the method will perform the step S12 to switch the N first switching units in the N first channels to connect with corresponding N second channels respectively according to a control signal and switch the other N first switching units in the N second channels to connect with corresponding N first channels respectively according to the control signal. Then, the method will perform the step S14 to switch the N second switching units in the N first channels to connect with corresponding N second channels respectively according to the control signal and switch the other N second switching units in the N second channels to connect with corresponding N first channels respectively according to the control signal.

If the judgment of the step S10 is that the driving circuit is operated under the second operation mode, the method will perform the step S16 to switch a first switching unit in any first channel to connect with another first channel according to the control signal, switch the other first switching unit in the any first channel to connect with the first channel, switch a first switching unit in any second channel to connect with another second channel according to the control signal, and also switch the other first switching unit in the any second channel to connect with the second channel according to the control signal. Then, the method will perform the step S18 to switch a second switching unit in a first channel to connect with another first channel according to the control signal, switch the other second switching unit in the another first channel to connect with the first channel, switch a second switching unit in a second channel to connect with another second channel according to the control signal, and switch the other second switching unit in the another second channel to connect with the second channel according to the control signal.

In practical applications, when N=4, the arrangement of the N first channels and N second channels of the driving circuit can meet the requirement of (2V+1) dot inversion.

For example, when N=4, the four first channels comprise a first first channel, a second first channel, a third first channel, and a fourth first channel, and the four second channels comprise a first second channel, a second second channel, a third second channel, and a fourth second channel; the first first channel is disposed adjacent to the second first channel and the first second channel; the second first channel is disposed adjacent to the first first channel and the second second channel; the first second channel is disposed adjacent to the first first channel and the second second channel; the third first channel is disposed adjacent to the fourth first channel and the third second channel; the fourth first channel is disposed adjacent to the third first channel and the fourth second channel; the third second channel is disposed adjacent to the third first channel and the fourth second channel.

Compared to the prior arts, the driving circuit of the invention different from the prior arts can not only meet the requirements of 1 dot inversion and (2V+1) dot inversion at the same time, but also when N=4, the specific arrangement of the four first channels and four second channels in the invention will not increase additional chip area occupied by the driving circuit. Therefore, the driving circuit of the invention and the LCD apparatus using the driving circuit will have good market competitiveness.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A driving circuit, applied in a LCD apparatus, the driving circuit comprising:

N first channels, wherein N is a positive integer and N≥2;

N second channels, corresponding to the N first channels respectively;

2N first switching units, disposed in the N first channels and the N second channels respectively; and 2N second switching units, disposed in the N first channels and the N second channels respectively;

wherein when the driving circuit is operated under a first operation mode, the N first switching units in the N first channels are switched to connect with corresponding N second channels respectively according to a control signal, and the other N first switching units in the N second channels are switched to connect with corresponding N first channels respectively according to the control signal; the N second switching units in the N first channels are switched to connect with corresponding N second channels respectively according to the control signal, and the other N second switching units in the N second channels are switched to connect with corresponding N first channels respectively according to the control signal; when the driving circuit is operated under a second operation mode, a first switching unit in any first channel is switched to connect with another first channel according to the control signal, and the other first switching unit in the another first channel is also switched to connect with the first channel; a first switching unit in any second channel is switched to connect with another second channel according to the control signal, and the other first switching unit in the another second channel is also switched to connect with the second channel according to the control signal; a second switching unit in the first channel is switched to connect with another first channel according to the control signal, and the other second switching unit in the another first channel is also switched to connect with the first channel; a second switching unit in the second channel is switched to connect with the another second channel according to the control signal, and the other second switching unit in the another second channel is also switched to connect with the second channel according to the control signal.

2. The driving circuit of claim 1, further comprising N first digital-to-analog converting units and N second digital-to-analog converting units, the N first digital-to-analog converting units and the N second digital-to-analog converting units are interlaced in the N first channels and the N second channels in order respectively.

3. The driving circuit of claim 2, wherein the N first digital-to-analog converting units are positive digital-to-analog converter and the N second digital-to-analog converting units are negative digital-to-analog converter.

4. The driving circuit of claim 1, wherein when N=4, the arrangement of the N first channels and N second channels of the driving circuit can meet the requirement of (2V+1) dot inversion.

5. The driving circuit of claim 1, wherein the 2N first switching units and the 2N second switching units are multiplexers.

6. A driving circuit operating method, applied in a driving circuit of a LCD apparatus, the driving circuit comprising N first channels, N second channels, 2N first switching units, and 2N second switching units, N being a positive integer and N≥2, the N second channels corresponding to the N first channels respectively, the 2N first switching units being disposed in the N first channels and the N second channels respectively, the 2N second switching units being disposed in the N first channels and the N second channels respectively, when the driving circuit is operated under a first operation mode, the driving circuit operating method comprising steps of:

switching the N first switching units in the N first channels to connect with corresponding N second channels respectively according to a control signal, and switching the other N first switching units in the N second channels to connect with corresponding N first channels respectively according to the control signal; and switching the N second switching units in the N first channels to connect with corresponding N second channels respectively according to the control signal, and switching the other N second switching units in the N second channels to connect with corresponding N first channels respectively according to the control signal;

wherein when the driving circuit is operated under a second operation mode, the method further comprises steps of:

switching a first switching unit in any first channel to connect with another first channel according to the control signal, and also switching the other first switching unit in the any first channel to connect with the first channel;

switching a first switching unit in any second channel to connect with another second channel according to the control signal, and also switching the other first switching unit in the any second channel to connect with the second channel according to the control signal;

switching a second switching unit in the first channel to connect with the another first channel according to the control signal, and also switching the other second switching unit in the another first channel to connect with the first channel; and switching a second switching unit in the second channel to connect with the another second channel according to the control signal, and also switching the other second switching unit in the another second channel to connect with the second channel according to the control signal.

7. The method of claim 6, wherein when N=4, the arrangement of the N first channels and N second channels of the driving circuit can meet the requirement of (2V+1) dot inversion.

8. The method of claim 7, wherein when N=4, the four first channels comprise a first first channel, a second first channel, a third first channel, and a fourth first channel, and the four second channels comprise a first second channel, a second second channel, a third second channel, and a fourth second channel; the first first channel is disposed adjacent to the second first channel and the first second channel; the second first channel is disposed adjacent to the first first channel and the second second channel; the first second channel is disposed adjacent to the first first channel and the second second channel; the third first channel is disposed adjacent to the fourth first channel and the third second channel; the fourth first channel is disposed adjacent to the third first channel and the fourth second channel; the third second channel is disposed adjacent to the third first channel and the fourth second channel.

9. A driving circuit, applied in a LCD apparatus, the driving circuit comprising:

N first channels, wherein N is a positive integer and N≥2;

N second channels, corresponding to the N first channels respectively;

2N first switching units, disposed in the N first channels and the N second channels respectively; and 2N second switching units, disposed in the N first channels and the N second channels respectively;

wherein when the driving circuit is operated under a first operation mode, the N first switching units in the N first channels are switched to connect with corresponding N second channels respectively according to a control signal, and the other N first switching units in the N second channels are switched to connect with corresponding N first channels respectively according to the control signal; the N second switching units in the N first channels are switched to connect with corresponding N second channels respectively according to the control signal, and the other N second switching units in the N second channels are switched to connect with corresponding N first channels respectively according to the control signal; and wherein when N=4, the four first channels comprise a first first channel, a second first channel, a third first channel, and a fourth first channel, and the four second channels comprise a first second channel, a second second channel, a third second channel, and a fourth second channel; the first first channel is disposed adjacent to the second first channel and the first second channel; the second first channel is disposed adjacent to the first first channel and the second second channel; the first second channel is disposed adjacent to the first first channel and the second second channel; the third first channel is disposed adjacent to the fourth first channel and the third second channel; the fourth first channel is disposed adjacent to the third first channel and the fourth second channel; the third second channel is disposed adjacent to the third first channel and the fourth second channel.

* * * * *